United States Patent [19]

Polzin et al.

[11] 4,198,003

[45] Apr. 15, 1980

[54] QUICK RELEASE FOR GYRATORY CRUSHER CONCAVE

[75] Inventors: Henry H. Polzin, Brookfield; Joseph Batch, Milwaukee, both of Wis.

[73] Assignee: Barber-Greene Company, Aurora, Ill.

[21] Appl. No.: 21,723

[22] Filed: Mar. 19, 1979

[51] Int. Cl.[2] ..... B02C 2/04

[52] U.S. Cl. ..... 241/30; 241/215; 241/290

[58] Field of Search ..... 241/30, 207–216, 241/290

[56] References Cited

U.S. PATENT DOCUMENTS

| | | | |
|---|---|---|---|
| 2,680,571 | 6/1954 | Bjarme | 241/290 |
| 3,038,670 | 6/1962 | Becker | 241/30 |
| 3,133,708 | 5/1964 | Bond et al. | 241/290 |
| 3,797,760 | 3/1974 | Davis et al. | 241/30 |
| 3,837,585 | 9/1974 | Decker et al. | 241/215 X |
| 3,951,348 | 4/1976 | Davis et al. | 241/207 X |

*Primary Examiner*—Howard N. Goldberg
*Attorney, Agent, or Firm*—James E. Nilles

[57] ABSTRACT

In a crusher having a gyratory conical crushing head that cooperates with an annular bowl, the bowl has a threaded connection with a frame member, to be adjustable up and down by rotation. A clamping ring, acting like a jam nut, also has a threaded connection with the frame member and is so connected with the bowl as to be constrained to rotate with it; but normally the bowl and clamping ring are biased towards one another under clamping force, to prevent bowl rotation. To release the bowl for rotation, pressurized air is injected between the bowl and the clamping ring, acting directly on them to overcome clamping force and being introduced via the helical passage defined by the threaded connection between clamping ring and frame member. Seals between the bowl and clamping ring, and between the bowl and frame member, prevent escape of the air.

7 Claims, 3 Drawing Figures

QUICK RELEASE FOR GYRATORY CRUSHER CONCAVE

FIELD OF THE INVENTION

This invention relates to gyrating or cone type crushers for rock, ore and the like, wherein a gyratory crushing head cooperates with a bowl or concave that is upwardly and downwardly adjustable; and the invention is more particularly concerned with means for readily releasing the bowl of such a crusher from locked relationship to a frame member that supports it, so that the bowl can be rotated for upward or downward adjustment relative to the frame member.

BACKGROUND OF THE INVENTION

In a crusher of the type to which this invention relates, a generally conical crushing head is mounted on an upright eccentric shaft to be gyrated by rotation of the eccentric. On the relatively stationary frame of the crusher there is an annular crushing bowl or concave that surrounds the crushing head and cooperates with it to define a gap which comprises an annular crushing chamber. Material to be crushed is fed downward between the bowl and the head, to be crushed by the gyration of the head.

The particle size of the output of such a crusher is dependent upon the size of the gap between the bowl and the crushing head. So that product particle size can be adjusted and compensation can be made for wear on the opposed surfaces of the crushing head and the bowl, it is customary to mount the bowl for up and down adjustment relative to the crusher frame whereby the crushing gap is widened by raising the bowl or narrowed by lowering it. For such adjustment, the bowl has a helically threaded connection with an upper frame member, and the bowl is shifted up or down by rotating it in the appropriate direction relative to the frame.

Once satisfactorily adjusted, the bowl must be prevented from rotating relative to the frame in response to the tangential forces imposed upon it by the gyrating crushing head. In many cases the bowl is releasably locked against rotation by a clamping ring just above the bowl that also has a helically threaded connection with the frame and functions in the same manner as a conventional lock nut or jam nut. Since the arrangement of the elements is such that adjusting rotation must be imparted to the bowl through the clamping ring, they are connected to rotate in unison but to be free for limited axial motion relative to one another. To lock the bowl against rotation, a substantial force is exerted between the bowl and the clamping ring whereby they are urged axially towards one another. For adjusting rotation of the bowl, this clamping force must of course be released.

Various arrangements have been proposed for providing the necessary clamping force between the bowl and the clamping ring, but heretofore there has been no satisfactorily simple and inexpensive arrangement that provides for both locking and unlocking of the bowl in a quick and facile manner.

U.S. Pat. No. 2,881,981 disclosed an arrangement wherein the rotation transmitting connection between the bowl and the clamping ring comprised an annular series of bolts or studs that were threaded into the bowl and projected upwardly from it through substantially closely fitting holes in the clamping ring. The upper end portion of each bolt was slotted to receive a wedge that overlay an upwardly facing surface on a part connected with the clamping ring and imposed a downward force upon the clamping ring while exerting an upward force upon the bowl through the bolt. Since there were a substantial number of bolts around the crusher, it was a tedious and laborious task to drive a wedge into each bolt slot in order to lock the bowl after an adjustment, and equally time consuming and troublesome to remove all of the wedges in order to unlock the bowl for adjustment. Arrangements generally similar to that of U.S. Pat. No. 2,881,981 are disclosed in the substantially later U.S. Pat. No. 3,533,568 and U.S. Pat. No. 3,614,023.

In the crushers of several other prior patents, as in that of the present invention in its preferred form, the bowl and the clamping ring were again connected for rotation by means of circumferentially spaced bolts secured in the bowl and projecting up from it through the clamping ring.

U.S. Pat. No. 3,204,883 disclosed an arrangement wherein a number of upright hydraulic jacks, arranged in a circle, reacted between parts that were respectively secured to the clamping ring and to the ring of bolts projecting up from the bowl. Pressure fluid was supplied to the several jacks for initial locking of the bowl, and thereafter the bowl was held in locked condition by mechanical locking means comprising wedges or locking pins, to permit hydraulic fluid pressure to be relieved without unlocking of the bowl.

U.S. Pat. No. 3,459,383 disclosed a toggle linkage for each of the bolts, each toggle linkage being actuatable to its overcenter clamping position to exert an upward force upon its bolt, and hence on the bowl, while exerting a downward reaction force upon the clamping ring. A double-acting hydraulic jack for each toggle linkage, extendable and retractable transversely to the links and connected to the swivel joint between them, moved the toggle to its clamping position and to its releasing position. Because of the overcenter arrangement of the toggle linkage, it could maintain its force-applying condition and lock the bowl even though fluid pressure on its actuator was subsequently relieved. Although quick acting and easy to operate, the arrangement was mechanically complex and quite expensive, because there had to be a substantial number of toggle linkages, each comprising several parts, and an equal number of hydraulic jacks.

U.S. Pat. No. 3,341,138 disclosed an arrangement wherein an upper portion of each bolt that connected the bowl and the clamping ring was surrounded by a compression spring that reacted downwardly against the clamping ring and upwardly against a nut on the top of the bolt. For releasing the axially convergent locking force thus exerted by each spring, a hydraulic jack was mounted above each bolt, on a cap that was fixed to the clamping ring and projected above it. When fluid pressure was applied to the jack, it extended to exert downward force on the top of its bolt, and thus upon the bowl, while imposing its upward reaction force upon the clamping ring through the cap. Upon relief of hydraulic pressure on the jacks, the springs could take over and urge the bowl and the clamping ring toward one another into locking relationship with the threaded frame portion. Although less complicated and costly than the arrangement of U.S. Pat. No. 3,459,383, and at least as satisfactory from a functional standpoint, the mechanism of U.S. Pat. No. 3,341,138 nevertheless required a number of hydraulic jacks and the numerous parts and fittings comprising their hydraulic systems.

By contrast to these prior art expedients, the present invention has as its general object the provision of an extremely fast-acting, simple and effective arrangement for locking the bowl of a gyratory crusher against rotation relative to the frame member that carries it and for unlocking it to be adjustingly rotated relative to that frame member, all without need for any cylinder jack or the like.

More specifically, the general object of the present invention is to provide a gyratory crusher having a bowl which is adjustable up and down by rotation and which is normally locked against such rotation by means of a clamping ring that is connected with the bowl to rotate in unison with it, in cooperation with spring means reacting between the bowl and the clamping ring to bias them towards one another, and having very simple means for overcoming the force of said spring means at times when the bowl is to be adjusted up or down, to thus permit the bowl and the clamping ring to be rotated relative to a frame member with which both have helically threaded connections.

Another object of the invention is to provide a bowl unlocking arrangement of the character described wherein fluid pressure is employed for bowl unlocking but wherein there are no hydraulic cylinders or the like and wherein the bowl is automatically locked against rotation as soon as fluid pressure is relieved.

A further object of the invention is to provide a gyratory crusher of the character described wherein the force that is employed to unlock the bowl or concave for up and down adjusting rotation is obtained from pressurized air, so that no contamination or fire hazard can result from any leak that might develop in the bowl unlocking system.

It is also a specific object of this invention to provide a pneumatic bowl unlocking arrangement wherein pressure air is applied directly to the bowl and the clamping ring, avoiding the cost and complexity of cylinder jacks and the like.

SUMMARY OF THE INVENTION

In general, the objects of the invention are achieved in a gyratory crusher having an annular frame member, an annular bowl having a concentric helically threaded connection with said frame member and cooperable with the gyratory crushing head of the crusher to define a crushing gap which is adjustable by rotation of the bowl relative to said frame member, a clamping ring which also has a threaded connection with said frame member and which is above the bowl and has a connection therewith that constrains the bowl and the clamping ring to rotate in unison but permits limited axial motion between them, and biasing means normally exerting clamping force upon the clamping ring and the bowl whereby they are urged axially towards one another to be confined against rotation relative to the frame member, said crusher being characterized by: means for injecting pressurized air between the clamping ring and the bowl; sealing means near the top and near the bottom of said frame member, providing sliding seals between said frame member and, respectively, the clamping ring and the bowl; and other sealing means providing a sliding seal between the clamping ring and the bowl, spaced radially from their threaded connections with said frame member, said other sealing means cooperating with the first mentioned sealing means to substantially confine pressurized air injected between the clamping ring and the bowl against escape, so that such air urges the clamping ring and the bowl axially apart with a force that overcomes said clamping force and releases the bowl for adjusting rotation relative to said frame member.

Preferably the first mentioned sealing means comprises a pair of concentric annular parts, one fixed on the clamping ring, the other fixed on said frame member, at the top thereof, one of said annular parts having an upwardly extending cylindrical surface radially spaced from said threaded connections and concentric to them, and the other of said annular parts projecting radially across said threaded connections and having slidable sealing engagement with said cylindrical surface, said annular parts cooperating to define an annular chamber which opens downwardly to the threaded connection between said frame member and said clamping ring; and said means for injecting pressurized air between the clamping ring and the bowl comprises means for introducing pressurized air into said annular chamber.

DETAILED DESCRIPTION OF THE INVENTION

Figure 1:
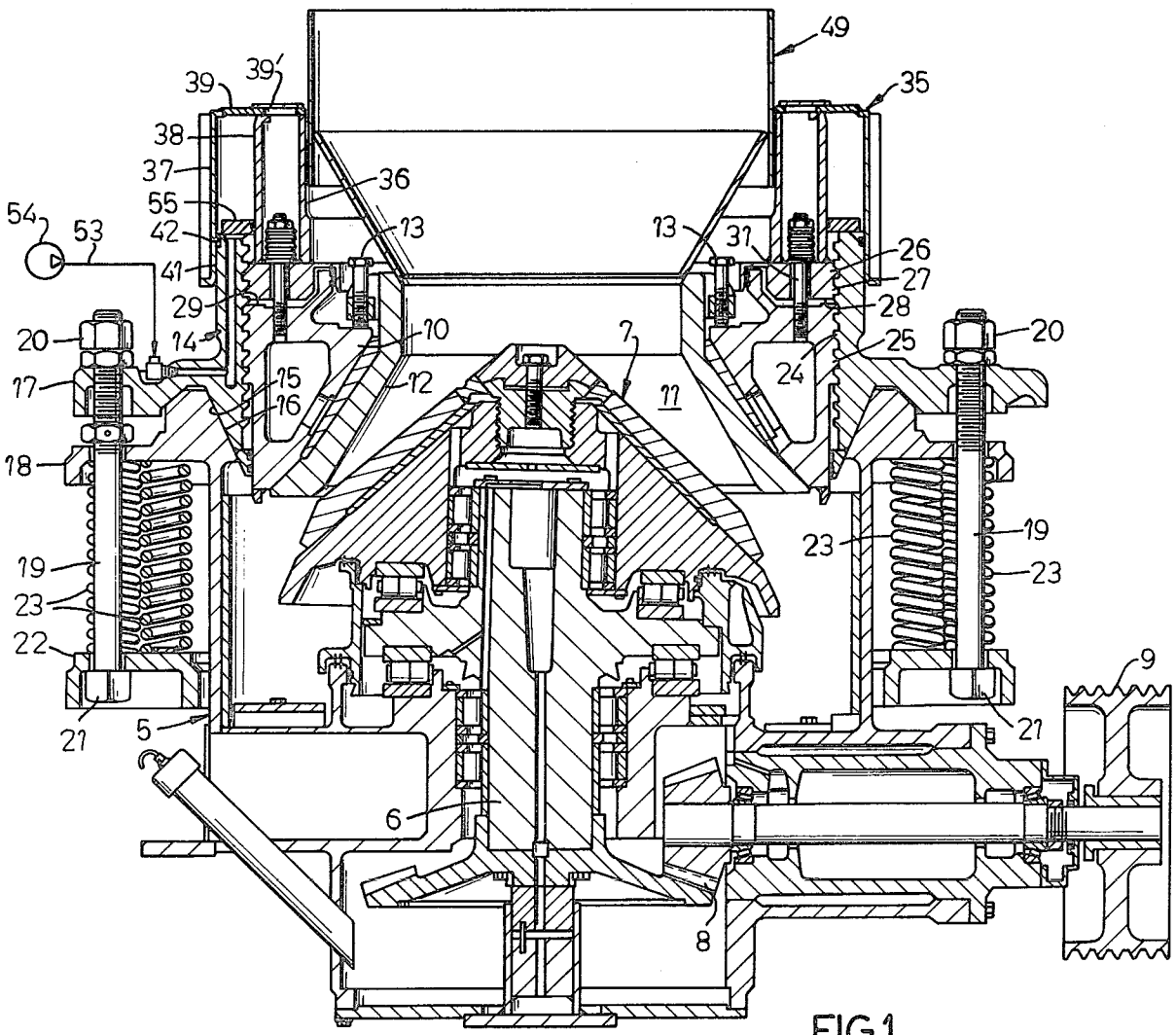
FIG. 1 is a view in vertical section of a gyratory crusher embodying the principles of this invention.

Referring now to the accompanying drawings, a gyratory crusher of the type to which the present invention is applicable comprises an annular main frame member 5, an eccentric shaft 6 rotatably journaled in the main frame member, a more or less conical crushing head 7 that is carried by the eccentric shaft 6 for gyratory motion, and conventional transmission means 8 by which the eccentric shaft is connected with a drive pulley 9.

The crushing head 7 cooperates with an annular crusher bowl or concave 10 that surrounds the conical head and is spaced above it. The frustoconical inner surface of the bowl 10 is downwardly and outwardly flared but converges downwardly towards the bottom of the crushing head 7 so that the crushing chamber 11 that comprises the gap between the crushing head and the bowl is downwardly tapered. As is usual, the inner surface of the bowl 10 is defined by a liner 12 that is removably secured to the bowl by means of conventional clamping bolts 13.

The bowl or concave 10 is supported by an annular upper frame member 14 that has near its bottom a radially outwardly facing conical surface 15 which is normally engaged against a mating conical surface 16 on the main frame member 5 to maintain the two frame members in coaxial relation to one another. The upper frame member 14 also has a radially outwardly projecting flange 17 above its conical surface 15, overlying but spaced above a generally similar flange 18 on the lower frame member 5. Each of a plurality of stud bolts 19 extends through the superimposed flanges 17 and 18. An adjusting nut 20 on the top of each stud bolt 19 overlies the flange 17 on the upper frame member 14, while another nut 21 on the bottom of each stud bolt supports a floating reaction ring 22 that is spaced a substantial distance below the flange 18 on the lower frame member. Reacting between the floating ring 22 and the lower flange 18 are a number of relief springs 23 that bias the upper frame member 14 downwardly and thus tend to maintain engagement between the mating conical surfaces 15 and 16 on the frame members; but in case tramp iron or excessively hard rock enters the crushing chamber 11 during operation of the crusher, the relief springs 23 can yield in axial compression, permitting a rising of the bowl 10 and the upper frame member 14 that supports it, to permit the bowl to move away from the crushing head 7 sufficiently for the hard object to escape without damaging the crusher parts.

Figures 2, 3, 4:
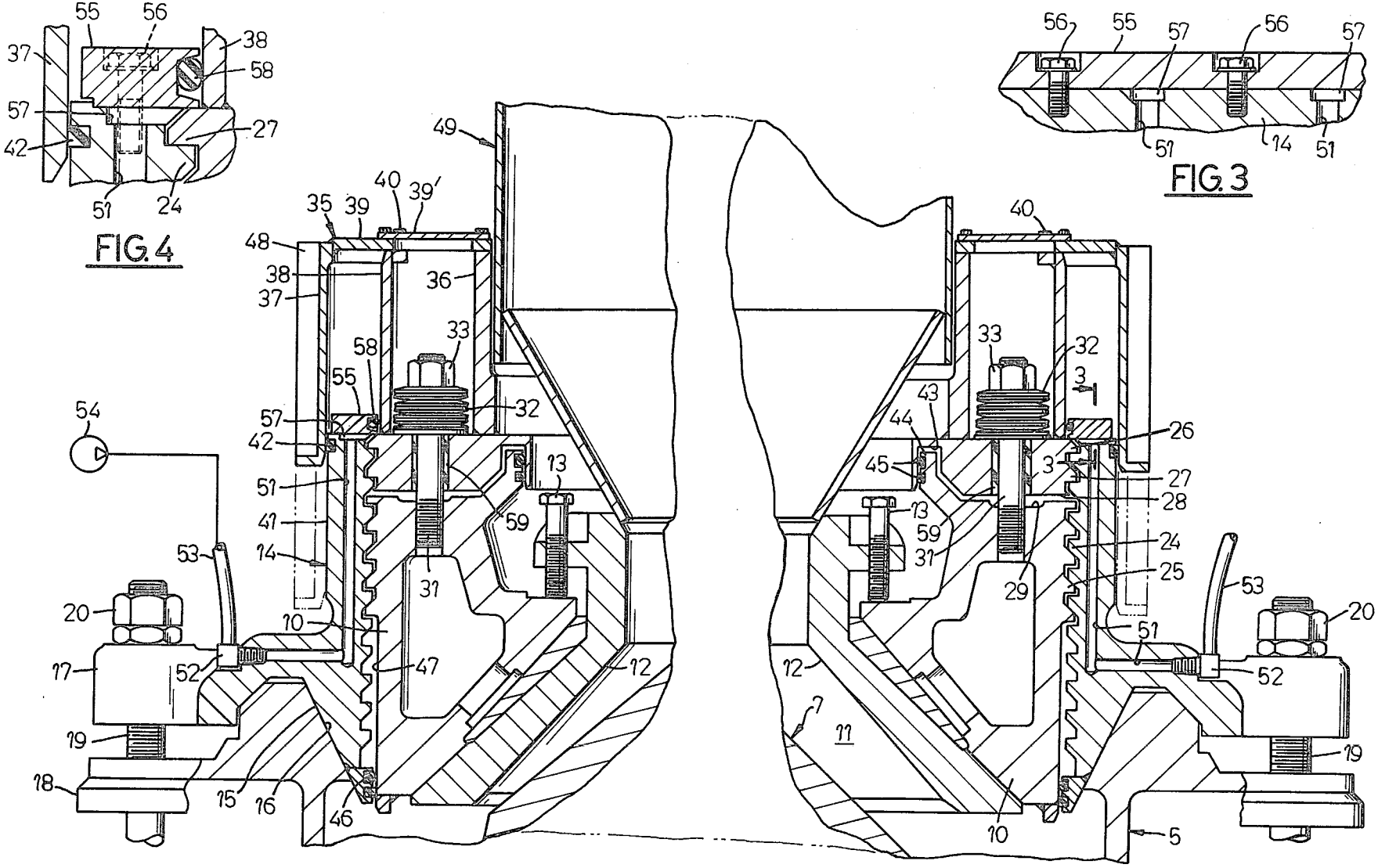
FIG. 2 is a view of the upper portion of the crusher, also in vertical section but on a larger scale.
FIG. 3 is a fragmentary sectional view on a still larger scale, taken on the plane of the line 3—3 in FIG. 2.
FIG. 4 is an enlarged fragmentary sectional view of the zone comprising the annular air chamber into which the air passages open.

To provide for up and down adjustment of the bowl 10 relative to the upper frame member 14 there is a helically threaded connection between them, comprising an internal helical thread 24 on the upper frame member and an external helical thread 25 on the bowl. The bowl 10 is adjusted up or down by rotating it in the appropriate direction relative to the upper frame member 14. Note that in FIG. 2 the bowl is shown adjusted to a higher position than in FIG. 1.

During normal operation of the crusher, the gyrating head 7 imposes forces upon the bowl 10 that tend to rotate it, but the bowl is restrained against such rotation by releasable locking means comprising a clamping ring 26 that has an external helical thread 27 which also mates with the internal thread 24 on the frame member. The clamping ring 26 is received in the upper frame member 14 above the bowl 10, so that the annular bottom surface 28 of the clamping ring opposes and is closely adjacent to the annular top surface 29 of the bowl.

The clamping ring 26 and the bowl 10 are constrained to rotate in unison by means of an annular series of bolts or studs 31 that are threaded into the bowl and project upwardly from it through closely fitting holes in the clamping ring 26. Surrounding an upper portion of each bolt 31 is a clamping spring device 32 that reacts downwardly upon the top of the clamping ring 26 and upwardly against a nut 33 that is threaded onto the topmost portion of the bolt. As shown, each clamping spring device 32 comprises a stacked group of resilient, bowl-shaped belleville washers. The biasing force that is normally exerted by the spring devices 32 urges the clamping ring 26 and the bowl 10 axially towards one another so that they cooperate with one another and with the upper frame member 14 to prevent mutual rotation of the bowl and the clamping ring relative to that frame member. The clamping ring 26 thus functions in substantially the same manner as a conventional lock nut or jam nut.

For the bowl to be adjusted up or down, the clamping force exerted by the spring devices 32 must of course be released or overcome, so that the bowl and the clamping ring can be rotated; but before proceeding to a description of the novel unlocking means that characterizes the present invention, attention must be given to certain other details of the crusher structure.

Secured to the top of the clamping ring 26 is a concentric annular cap 35 that comprises an upright radially inner wall 36, an upright radially outer annular wall 37, and an upright intermediate annular wall 38. The radially inner cap wall 36 is welded at its bottom to the top of the clamping ring 26, radially inwardly of the ring of bolts or studs 31; and the intermediate cap wall 38 is similarly welded to the top of the clamping ring, radially outside those bolts but a small distance radially inward of the external thread 27 on the clamping ring. The cap also comprises an annular top wall 39 which is detachably secured, as by bolts 40, to the radially inner wall 36 and to the intermediate wall 38. This top wall 39 projects radially outwardly beyond the intermediate wall 38, and the radially outer wall 37 is secured to the outer edge of the top wall 39 and projects down from it to have its lower portion in closely surrounding relation to a cylindrical outer surface 41 on the upper frame member 14. To permit access to the nuts 33 for adjustment of the clamping spring devices 32, the top wall 39 of the cap has a large hole in line with each such nut, and the ring of holes is normally closed by a removable annular cover plate 39'.

To provide a slidable dirt seal between the cap 35 and the cylindrical frame member surface 41, the latter has near its top a circumferential outwardly opening groove in which there is a sealing ring 42 that engages the outer cap wall 37.

Between the clamping ring 26 and the bowl 10 there is also an annular seal, located radially inwardly of the helically threaded connections 24, 25, 27. For that seal, the radially inner portion of the clamping ring 26 has a downwardly opening annular groove 43 in which is received an upwardly projecting annular flange 44 on the bowl, and there is a sealing ring 45 between the cylindrical radially inwardly facing surface of said flange 44 and the opposing cylindrical surface of the groove 43.

One other sliding seal, comprising a sealing ring 46, prevents dust and dirt from working upward into the threaded connection 24, 25 between the bowl 10 and the upper frame member 14. The radially outer surface of the bowl, which has substantial axial depth, has the external thread 25 only on its upper portion and is unthreaded and cylindrical therebeneath, as at 47. The sealing ring 46, which is received in a radially inwardly opening circumferential groove in the frame member 14, below its internal thread 24, engages the cylindrical surface 47 on the bowl.

Fitting closely within the embrace of the inner annular cap wall 36 is a conventional hopper 49, having a cylindrical upper portion and a frustoconical lower portion that converges downwardly towards the top of the bowl 10, to which the hopper is secured. The hopper 49 of course receives material to be processed through the crusher and guides it down into the crushing chamber 11, to which the hopper opens downwardly.

As is conventional, the annular cap 35 not only serves to support the hopper 49 but also serves as a means for imparting adjusting rotation to the bowl 10 through the clamping ring 26 and the bolts or studs 31; and for the latter purpose it can have axially extending ribs 48 on its exterior by which torque can be applied to it.

In accordance with the present invention, the axially convergent clamping force that is exerted upon the bowl 10 and the clamping ring 26 by the spring devices 32 is overcome and released by pressurized air that is forced between the bottom surface 28 of the clamping ring 26 and the opposing top surface 29 of the bowl 10. Because of the relatively large areas of those annular surfaces, the air need not have an unduly high pressure in order to be capable of overcoming the axial clamping force exerted by the spring devices 32.

For introducing pressurized air between the bowl 10 and the clamping ring 26 there are a number of upright air passages 51 in the upper frame member 14, at circumferentially spaced intervals around it. Each air passage 51 has an inlet 52 that is located at a readily accessible portion of the exterior of the upper frame member and is communicated, as by means of a pressure hose 53, with a source of pressure air illustrated as an air pump 54. Because the frame member 14 does not rotate, and is confined to only limited up and down motion relative to the main frame member 5, the pneumatic connections to the air passages 51 can be very simple ones, and the pump 54 or other pressure air source can be fixed in relation to the crusher frame.

Each of the air passages 51 has its outlet at a radially inwardly opening slot or bay 57 in the otherwise flat top surface of the upper frame member 14. Overlying that top surface is a manifold ring 55 that deflects the air radially inwardly through the slots or bays 57 and into the threaded connection between the upper frame member and the clamping ring 26. The manifold ring 55 is flatwise secured to the top surface of the upper frame member 14 by means of bolts 56 that extend downward through that ring and are threaded into the frame member in circumferentially spaced relation to one another and to the air passages 51.

The radially inner surface of the manifold ring 55 has a sliding seal with the cylindrical outer surface of the intermediate wall 38 of the cap, comprising a sealing ring 58 confined in a radially inwardly opening groove in the manifold ring. It will be seen that the manifold ring 55 and the annular wall 38 cooperate to define an annular chamber into which all of the air passage slots 57 open and which, in turn, opens downwardly to the threaded connection 24, 27 between the clamping ring 26 and the upper frame member 14. Note that the dirt seal 42 between the outer cap wall 37 and the upper frame member 14 keeps dust and dirt off of the outer air sealing surface of the intermediate annular cap wall 38.

The external thread 27 on the clamping ring and the internal thread 24 on the upper frame member 14 define a helical passage through which pressure air flows from the annular chamber just mentioned into the space between the bowl 10 and the clamping ring 26. To maintain pressure in that space by which the bowl 10 and clamping ring 26 are forced apart against the bias of the spring devices 32, the holes in the clamping ring through which the bolts 31 pass are preferably provided with resilient bushings 59. Besides keeping dust and dirt out of the helical threads 24, 25, 27, the seals that comprise the rings 45 and 46 respectively prevent pressure air from leaking out of the space between the bowl and the clamping ring and out of the bottom end of the helical passage defined by the threads 24 and 25 on the frame member 14 and the bowl 10.

It will be apparent that when the bowl 10 is to be adjusted up or down, it is merely necessary to supply pressure air to the passage inlets 52, and then rotate the cap 35 in the proper direction for up or down adjustment of the bowl. When air pressure is released, the spring devices 32 promptly take over and lock the bowl against rotation.

Since the manifold ring 55 partly overlies the clamping ring 26, the uppermost position of adjustment of the bowl 10 is defined by engagement of the clamping ring against the underside of the manifold ring; hence the bowl and the clamping ring cannot be inadvertently rotated to a position in which the clamping ring is disengaged from the upper frame member 14.

However, removal of the clamping ring and the bowl from the upper frame member 14, as for replacement of the bowl liner 12, is relatively simple. The top wall 39 of the cap 35 is removed, by removal of the bolts 40, and this gives access to the nuts 33 so that they and the spring devices 32 can be removed from the bolts 31. The outer upright wall 37 of the cap comes away with its top wall 39, permitting ready access to the bolts 56 that secure the manifold ring 55 to the upper frame member 14; and with removal of the manifold ring the clamping ring 26 and the bowl 10 are of course readily removable from the upper frame member. It will be observed that this disassembly procedure is not significantly complicated by the presence of the pneumatic bowl unlocking system of this invention.

From the foregoing description taken with the accompanying drawings it will be apparent that the bowl of a gyratory crusher embodying the principles of the present invention is normally locked against upward and downward adjusting rotation but can be very quickly and easily released for such rotation and just as quickly locked again; and it will also be apparent that the invention does not require the presence on the crusher of cylinder jacks or similar actuating mechanisms and permits the use of pneumatic pressure connections that are simple and sturdy so as to be well adapted for withstanding the vibration to which crusher structures are subjected.

We claim:

1. A crusher having a gyratory crushing head, an annular frame member, an annular bowl having a concentric helically threaded connection with said frame member and cooperable with said crushing head to define a crushing gap which is adjustable by rotation of the bowl relative to said frame member, a clamping ring which also has a threaded connection with said frame member and which is above the bowl and has a connection therewith that constrains the bowl and the clamping ring to rotate in unison but permits limited axial motion between them, and biasing means normally exerting clamping force upon the clamping ring and the bowl whereby they are urged axially towards one another to be confined against rotation relative to the frame member, said crusher being characterized by:

A. means for injecting pressurized air between the clamping ring and the bowl;

B. sealing means near the top and near the bottom of said frame member, providing sliding seals, respectively;

(1) between said frame member and the clamping ring and (2) between said frame member and the bowl; and C. other sealing means providing a sliding seal between the clamping ring and the bowl, spaced radially from their threaded connections with said frame member, said other sealing means cooperating with the first mentioned sealing means to substantially confine pressurized air injected between the clamping ring and the bowl against escape, so that such air urges the clamping ring and the bowl axially apart with a force that overcomes said clamping force and releases the bowl for adjusting rotation relative to said frame member.

2. The crusher of claim 1, further characterized by:

D. said first mentioned sealing means comprising a pair of concentric annular parts, one fixed on the clamping ring and the other fixed on said frame member, at the top thereof, one of said annular parts having an upwardly extending cylindrical surface radially spaced from said threaded connections and concentric to them, and the other of said annular parts projecting radially across said threaded connections and having slidable sealing engagement with said cylindrical surface, said annular parts cooperating to define an annular chamber which opens downwardly to the threaded connection between said frame member and said clamping ring; and E. said means for injecting pressurized air between the clamping ring and the bowl comprising means for introducing pressurized air into said annular chamber.

3. A crusher comprising a gyratory crushing head, an annular upper frame member having an internal thread, an annular bowl having an external thread engaged with said internal thread and cooperable with said crushing head to define a crushing gap which is adjustable by rotation of the bowl relative to said frame member, an annular clamping member above said bowl, said clamping member also having an external thread engaged with said internal thread and having a connection with the bowl that constrains it and the bowl to rotate in unison relative to said frame member, and biasing means normally exerting clamping force upon the bowl and the clamping member by which they are urged axially towards one another to confine the bowl against rotation relative to the frame member, said crusher being characterized by:

A. means on one of said members defining a cylindrical surface which projects upwardly from said one member in concentric radially spaced relation to the thread thereon;

B. an annular chamber-defining element on the top of the other of said members projecting radially across the thread thereon and having slidable sealing engagement with said cylindrical surface to cooperate therewith in defining an annular chamber which is above said frame member and said clamping member and which opens downwardly to the helical passage conjointly defined by the threads on said members;

C. means for introducing pressurized air into said chamber so that such air, flowing along said helical passage, can force itself between the clamping member and the bowl; and D. cooperating slidable sealing means (2) on the clamping member and the bowl, spaced radially inwardly from the threads on them, and (2) on the bowl and said frame member, near the bottoms thereof, whereby pressurized air that forces itself between the bowl and the clamping member is substantially confined between them to urge them axially apart with a force which overcomes said clamping force and thus frees the bowl for rotation by which the crushing gap is adjusted.

4. The crusher of claim 3 wherein said annular chamber defining element is on said frame member, further characterized by:

means releasably securing said annular chamber-defining element to said frame member to permit upward removal of the clamping member from said frame member.

5. The crusher of claim 3, further characterized by:

(1) said means defining a cylindrical surface comprising an upright annular wall secured to the top of said clamping member and projecting upwardly therefrom;

(2) an annular top wall secured to said upright annular wall and projecting radially outwardly therefrom; and (3) an outer annular cap wall secured to said top wall and projecting downwardly therefrom in surrounding relation to a cylindrical outer surface on said frame member, said outer annular cap wall (a) having means thereon for application of torque thereto by which the bowl can be rotated, and (b) cooperating with said cylindrical outer surface on said frame member to provide a dirt seal by which dirt is kept off of said cylindrical surface of the first mentioned annular wall.

6. A method of releasing the bowl of a gyratory crusher for rotation relative to a frame member with which the bowl has a helically threaded connection, to provide for adjustment of a crushing gap between the bowl and a gyratory crushing head with which the bowl cooperates, said bowl being cooperable with rotation restraining means comprising a clamping ring which also has a helically threaded connection with said frame member, connecting means constraining the bowl and the clamping ring to rotate in unison but permitting limited axial motion between them, and means yieldingly biasing the bowl and the clamping ring axially towards one another with a clamping force that causes the clamping ring and said frame member to cooperate in normally confining the bowl against rotation, said method being characterized by:

introducing air under pressure between the bowl and the clamping ring, to urge them axially apart with a force that overcomes said clamping force and thus releases them for rotation relative to said frame member.

7. A method of releasing the bowl of a gyratory crusher for rotation relative to an annular frame member that has an internal helical thread with which an external helical thread on the bowl is engaged, to provide for adjustment of a crushing gap between the bowl and a gyratory crushing head with which the bowl cooperates, said bowl having a connection with a clamping ring that also has an external helical thread engaged with said internal thread, said connection permitting limited axial motion between the bowl and the clamping ring but constraining them to rotate in unison relative to said frame member, and there being biasing means reacting between the bowl and the clamping ring to urge them axially towards one another with a clamping force whereby the bowl is normally confined against rotation, said method being characterized by:

directing pressurized air along said internal helical thread from near one axial end thereof so that such air, flowing in the helical passage conjointly defined by said internal thread and one of said external threads, is introduced between the adjacent opposing surfaces of the bowl and the clamping ring to urge them apart with a force which overcomes said clamping force and thus releases the bowl and the clamping ring for rotation relative to the frame member.

* * * * *